US007314295B2

(12) United States Patent
Legat et al.

(10) Patent No.: US 7,314,295 B2
(45) Date of Patent: Jan. 1, 2008

(54) CEILING LIGHT WITH AN OBLONG LIGHT HOUSING

(75) Inventors: Jean-Jacques Legat, Colombe (FR); Didier Girard, Lyons (FR)

(73) Assignee: A. Raymond & CIE

( * ) Notice: Subject to any disclaimer, the term of this patent is extended or adjusted under 35 U.S.C. 154(b) by 367 days.

(21) Appl. No.: 10/524,320

(22) PCT Filed: Jul. 26, 2003

(86) PCT No.: PCT/EP03/08282

§ 371 (c)(1),
(2), (4) Date: Feb. 9, 2005

(87) PCT Pub. No.: WO2004/020900

PCT Pub. Date: Mar. 11, 2004

(65) Prior Publication Data

US 2006/0018111 A1 Jan. 26, 2006

(30) Foreign Application Priority Data

Aug. 9, 2002 (DE) ..... 102 36 500

(51) Int. Cl.
*F21V 17/00* (2006.01)

(52) U.S. Cl. ..... 362/375; 362/365; 362/223

(58) Field of Classification Search ..... 362/217, 362/147–148, 225, 374–375
See application file for complete search history.

(56) References Cited

U.S. PATENT DOCUMENTS

| | | | | |
|---|---|---|---|---|
| 2,951,611 | A * | 9/1960 | Janness et al. | 362/221 |
| 4,580,200 | A * | 4/1986 | Hess et al. | 362/223 |
| 5,172,976 | A * | 12/1992 | Bogdanovs | 362/374 |
| 5,226,724 | A | 7/1993 | Kanarek | |
| 6,210,026 | B1 * | 4/2001 | Hornung et al. | 362/490 |

FOREIGN PATENT DOCUMENTS

| | | |
|---|---|---|
| CH | 457623 | * 11/1967 |
| DE | 1298422 | * 11/1967 |

* cited by examiner

*Primary Examiner*—Ali Alavi
(74) *Attorney, Agent, or Firm*—Dickinson Wright PLLC

(57) ABSTRACT

The invention relates to a ceiling light with an oblong light housing. The above comprises a dished upper piece (1), provided with brackets (5), for mounting at least one fluorescent tube (6), fixings (8) and clamps (9), for the corresponding electrical ballast devices and cables and fixing elements for securing the upper piece (1) to a ceiling board (17) and a transparent lower piece (2), provided with detachable clip elements (12), for connection to the upper piece (1). The upper piece (1) and the lower piece (2) are moulded from hard elastic plastic and pivotably connected to each other along a longitudinal edge by means of a so-called integral hinge (3).

11 Claims, 1 Drawing Sheet

CEILING LIGHT WITH AN OBLONG LIGHT HOUSING

CROSS-REFERENCE TO RELATED APPLICATIONS

This application is a National Stage of International Application No. PCT/EP03/08282, filed on Jul. 26, 2003, which claims priority to German Patent Application No. 102 36 500.8, filed on Aug. 9, 2002. The disclosures of the above applications are incorporated herein by reference.

BACKGROUND OF THE INVENTION

The invention pertains to a ceiling light with an elongated light housing, comprising a trough-shaped top part, which is provided with brackets for holding at least one fluorescent tube, with holders for the associated electrical ballasts and cables, and also with fastening elements for anchoring the top part in the ceiling, and a transparent bottom part supported so that it can pivot about a longitudinal edge of the top part with detachable locking elements for connecting to the top part.

Ceiling lights of this type are generally known and are used especially for illuminating office spaces, factory spaces, warehouses, and other work spaces. These ceiling lights should be easy to handle and mount. But, it is also important that the bottom part be easy to open and close for replacing fluorescent tubes. Because the ceiling lights are required in large quantities according to the room size, low installation costs are another incentive for manufacturing these lights as inexpensively as possible.

From EP 0 726 420 B1, a ceiling light of the type mentioned above is shown, which comprises a closed, two-part housing. Both housing parts are made from plastic, with the bottom part, the so-called cover, being attached to the top part, the so-called housing base, detachably by means of fastening elements.

The fastening elements are four so-called snap closures, which are arranged opposite each other on the broad sides of the housing in its end region. The snap closures are preferably formed by C-shaped clasps, which are jammed into the bottom groove with a peg-shaped clasp base, and their top claw-shaped closing ends cover the bases of the top groove with a clamping effect.

The closing element is very complicated and labor-intensive for the assembly of the ceiling light. Also, too much is asked of the assembler for the changing of defective fluorescent tubes, which can rarely be completed without outside help. Here, it appears to be especially disadvantageous that the assembler must temporarily store the cover after releasing the closing parts so that both hands remain free for the changing process. There is no question that this ceiling light is not only expensive in production and assembly, but a handyman is also always needed to change the fluorescent tubes.

SUMMARY OF THE INVENTION

The problem of the invention is to provide a ceiling light of the previously mentioned type that eliminates these disadvantages. This problem is solved according to the present invention for the ceiling light described in the introduction such that the top part and the bottom part are injection molded in one piece from plastic, and furthermore, the bottom part and the top part are connected to each other so that they can each pivot about a longitudinal edge by means of a so-called film hinge.

This configuration allows not only significantly reduced production costs, but also simplified handling during assembly of the light housing and above all during the opening and closing of the bottom part when the fluorescent tubes are changed. Through the one-piece injection molding of the light housing, in a further configuration of the invention, the bottom part can be shaped in a simple way so that it comprises a frame with connecting ribs extending transversely over the entire length and with a V-shaped cross-sectional profile.

Additional features of the invention result from the subordinate claims and the subsequent description of a preferred embodiment shown in the drawing.

BRIEF DESCRIPTION OF THE DRAWINGS

The invention is described in more detail in the following with reference to the attached drawing as an example; shown are.

DETAILED DESCRIPTION OF THE PREFERRED EMBODIMENT

Figure 1:
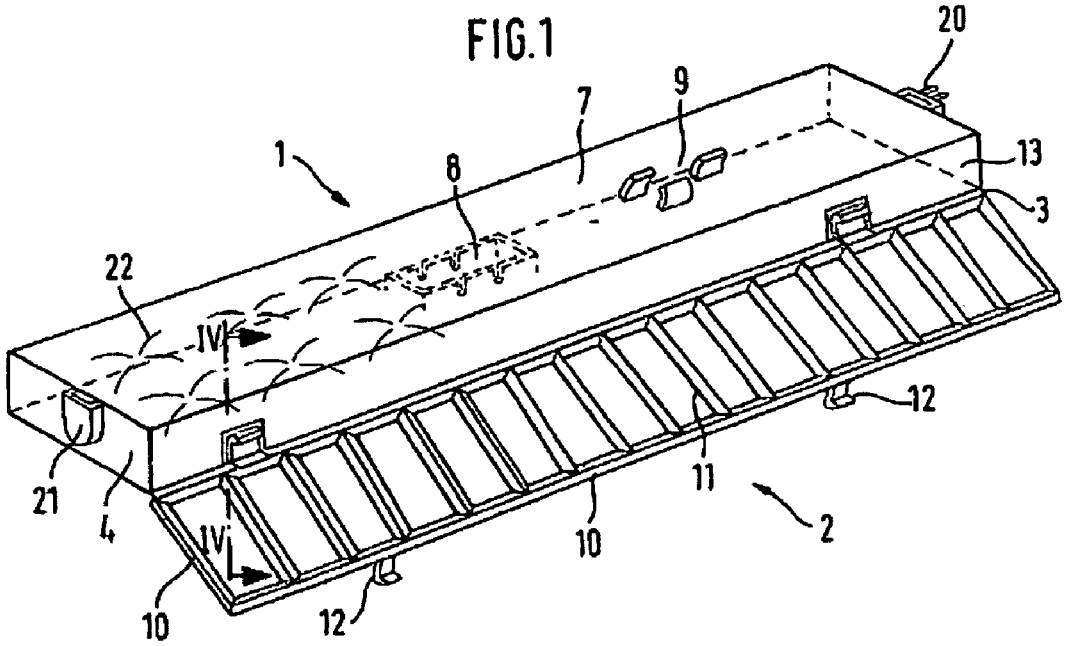
FIG. 1, an oblique view of a light housing according to the invention with folded-open bottom parts in a top view from above, FIG. 2, a cross section through the light housing with folded-open bottom part before installation in the ceiling plate, FIG. 3, the same cross section through the light housing in the installed state with closed bottom part, FIG. 4, an enlarged cut-out of the cross section through the housing wall according to line IV-IV in FIG. 1, and FIG. 5, an enlarged cut-out "A" of the cross section through the housing wall in the region of the locking elements.

The ceiling light shown in the figures essentially comprises an elongated, trough-shaped top part 1 and a transparent bottom part 2. Both parts are injection molded in one piece from plastic and connected to each other so that they can pivot about a longitudinal edge by means of a so-called film hinge 3.

The top part 1 is provided on the insides of both end walls 4 with brackets 5 for holding at least one fluorescent tube 6. In the ceiling 7 of the top part 1, holders 8 and clamps 9 for the associated ballasts and cable lines are also integrated, which are typically needed for operating fluorescent tubes 6.

Figure 3:
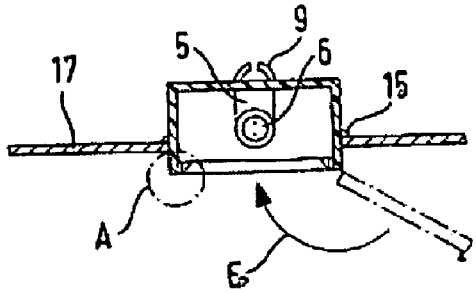
Figure 5:
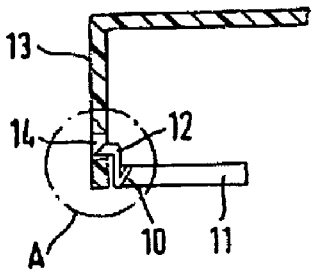

The bottom part 2 comprises a frame 10 with connecting ribs 11 extending transversely over the entire length and with a V-shaped cross-sectional profile. For detachable fastening of the bottom part 2 on the top part 1, locking elements 12 are formed on the frame 10 on the side opposite the film hinge 3 (FIGS. 3 and 5). These locking elements 12 engage in correspondingly sized recesses 14 in the longitudinal wall 13 when the bottom part 2 is pivoted into the top part 1 in the direction of arrow "E".

Figure 2:
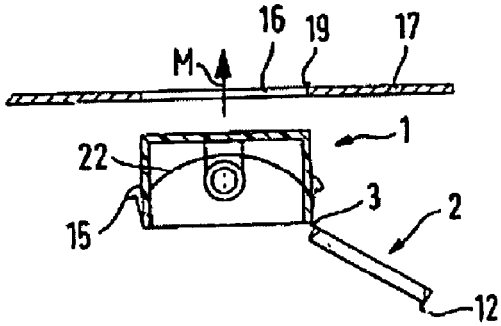
Figure 4:
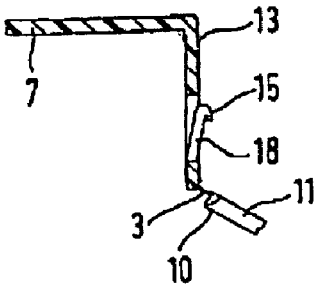

In the longitudinal walls 13 of the top part 1 there are locking hooks 15 extending past the outer surface on both sides. These hooks are formed on the longitudinal walls 13 so that they can be pressed together by means of spring pins 18, as can be seen from FIG. 4. These locking hooks 15 are dimensioned so that they expand when the light housing is inserted into a recess 16 adapted to the top part 1 in the ceiling plate 17 in the direction of arrow "M" (FIG. 2) up to and behind the outer surface and edge of the ceiling plate 19 to engage the recess 16.

In the two end walls 4 of the top part 1, an attachment plug 20 and an attachment socket 21 are each integrated on the outer sides. Therefore, it is possible to electrically connect several light housings to each other with these integrated plugs 20 and sockets 21 and thereby extend the length of the ceiling light assembly.

The cover 7 of the top part 1 can be configured advantageously on its bottom side with corresponding bulges as reflectors 22, on which, for this purpose, a good reflective metal layer is applied, so that, as for a metal housing, the light rays of the fluorescent tubes are completely reflected downwards.

The invention claimed is:

1. A ceiling light apparatus with an elongated light housing, comprising:

a trough-shaped top part (1), said trough-shaped top part comprising:

a bracket (5) for holding at least one fluorescent tube (6), a holder (8) and a clamp (9) for an electrical ballast and a cable, and a plurality of longitudinal walls (13), said longitudinal walls comprising a plurality of locking hooks (15) for anchoring in a recess (16) adapted to the top part (1) in the ceiling plate (17) by means of spring pins (18) that can be elastically compressed, and a transparent bottom part (2) pivotably connected to a longitudinal edge of the top part (1), said bottom part comprising detachable locking elements (12) for connecting to the top part (1), wherein the top part (1) and the bottom part (2) are injection molded in one piece from a hard-elastic plastic material.

2. A ceiling light apparatus according to claim 1, wherein the bottom part (2) comprises a frame (10) with connecting ribs (11), said connecting ribs having a V-shaped cross-sectional profile.

3. A ceiling light apparatus according to claim 2, wherein an attachment plug (20) and an attachment socket (21) are integrated in the top part (1), said attachment plug and attachment socket being capable of being connected electrically with a corresponding plug and socket of a second ceiling light apparatus.

4. A ceiling light apparatus according to claim 3, wherein the top part comprises a cover (7), said top part comprising a reflector (22), said reflector comprising a good reflective metal layer.

5. A ceiling light apparatus according to claim 1, wherein an attachment plug (20) and an attachment socket (21) are integrated in the top part (1), said attachment plug and attachment socket being capable of being connected electrically with a corresponding plug and socket of a second ceiling light apparatus.

6. A ceiling light apparatus according to claim 5, wherein the top part comprises a cover 7, said top part comprising a reflector (22), said reflector comprising a good reflective metal layer.

7. A ceiling light apparatus according to claim 1, wherein the top part comprises a cover 7, said top part comprising a reflector (22), said reflector comprising a good reflective metal layer.

8. A ceiling light apparatus comprising:

a trough-shaped top part (1), said top part comprising:

a bracket (5) for holding at least one fluorescent tube (6), a holder (8) and a clamp (9) for an electrical ballast and cable, and a plurality of locking hooks (15), said locking hooks comprising spring pins (18) that are capable of being pressed together elastically and anchoring the top part in a recess (16) in a ceiling plate (17) adapted to the top part (1), a transparent bottom part (2), said bottom part being pivotably connected to a first longitudinal edge of the top part (1), said bottom part comprising a plurality of detachable locking elements (12) for connecting to the top part (1), said locking elements comprising a hook shape on a frame (10) of the bottom part (2), wherein the locking elements engage a plurality of correspondingly sized recesses (14) formed in a second longitudinal edge of the top part when the bottom part (2) is pivoted into the top part (1), and wherein the top part (1) and the bottom part (2) are injection-molded in one piece from a hard-elastic plastic material.

9. A ceiling light apparatus according to claim 8, further comprising an attachment plug (20) and an attachment socket (21), said attachment plug and attachment socket being capable of being connected electrically with a corresponding plug and socket of a second ceiling light apparatus.

10. A ceiling light apparatus according to claim 8, wherein the top part comprises a cover (7), said top part comprising a reflector (22), said reflector comprising a good reflective metal layer.

11. A ceiling light apparatus according to claim 10, further comprising an attachment plug (20) and an attachment socket (21), said attachment plug and attachment socket being capable of being connected electrically with a corresponding plug and socket of a second ceiling light apparatus.

* * * * *